US009742098B2

(12) United States Patent
Zhao et al.

(10) Patent No.: US 9,742,098 B2
(45) Date of Patent: Aug. 22, 2017

(54) ELECTRICAL CONNECTOR HAVING WATERPROOF FUNCTION

(71) Applicant: FOXCONN INTERCONNECT TECHNOLOGY LIMITED, Grand Cayman (KY)

(72) Inventors: Jun Zhao, HuaiAn (CN); Jing-Jie Guo, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/088,145

(22) Filed: Apr. 1, 2016

(65) Prior Publication Data

US 2016/0294105 A1 Oct. 6, 2016

(30) Foreign Application Priority Data

Apr. 2, 2015 (CN) ..... 2015 1 0153847

(51) Int. Cl.
*H01R 13/52* (2006.01)
*H01R 13/6581* (2011.01)
*H01R 12/72* (2011.01)

(52) U.S. Cl.
CPC ..... *H01R 13/5202* (2013.01); *H01R 12/724* (2013.01); *H01R 13/6581* (2013.01)

(58) Field of Classification Search
CPC H01R 13/5202; H01R 12/724; H01R 13/658; H01R 13/64; H01R 24/62; H01R 13/40
USPC ..... 439/271, 607.05, 78, 519
See application file for complete search history.

(56) References Cited

U.S. PATENT DOCUMENTS

| | | | | |
|---|---|---|---|---|
| 8,801,463 | B2 * | 8/2014 | Tan | H01R 13/5202 439/607.04 |
| 9,112,299 | B2 * | 8/2015 | Lu | H01R 13/5227 |
| 9,263,836 | B2 * | 2/2016 | Zhao | H01R 13/6594 |
| 9,385,484 | B2 * | 7/2016 | Chen | H01R 13/6582 |
| 9,484,662 | B2 * | 11/2016 | Guo | H01R 13/504 |
| 9,484,679 | B2 * | 11/2016 | Guo | H01R 13/6585 |
| 2014/0302709 | A1 | 10/2014 | Zhao et al. | |
| 2015/0044886 | A1 | 2/2015 | Little et al. | |
| 2015/0222059 | A1 * | 8/2015 | Little | H01R 13/6587 439/607.55 |

(Continued)

FOREIGN PATENT DOCUMENTS

TW M419287 12/2011

*Primary Examiner* — Alexander Gilman
(74) *Attorney, Agent, or Firm* — Wei Te Chung; Ming Chieh Chang

(57) ABSTRACT

An electrical connector includes an insulative housing, a number of contacts accommodated in the insulative housing, a metal shell attached to the housing and defining a receiving space and a waterproof portion formed behind the receiving space. The insulative housing includes a groove, a tongue portion located in front of the groove, and a holding potion located behind the groove. The holding portion has a dispensing port communicating with the groove and an exterior. Each contact has a contacting section exposed on the tongue portion, a connecting section exposed from the groove, a holding section accommodated in the holding portion of the insulative housing, and a soldering section extending from the holding portion. The waterproof portion is received in the groove.

20 Claims, 11 Drawing Sheets

(56) References Cited

U.S. PATENT DOCUMENTS

| | | | | |
|---|---|---|---|---|
| 2015/0244111 | A1* | 8/2015 | Ju | H01R 13/6585<br>439/607.05 |
| 2015/0325944 | A1 | 11/2015 | Chien et al. | |
| 2016/0020549 | A1* | 1/2016 | Chen | H01R 13/5202<br>439/78 |
| 2016/0056586 | A1* | 2/2016 | Guo | H01R 13/41<br>439/607.05 |
| 2016/0104957 | A1* | 4/2016 | Kim | H01R 13/6581<br>439/78 |
| 2016/0104976 | A1* | 4/2016 | Yu | H01R 13/6585<br>439/607.05 |
| 2016/0149349 | A1* | 5/2016 | Kao | H01R 13/6586<br>439/607.05 |

* cited by examiner

ELECTRICAL CONNECTOR HAVING WATERPROOF FUNCTION

BACKGROUND OF THE INVENTION

1. Field of the Invention

The present invention relates generally to an electrical connector, and more particularly to an electrical connector having a waterproof function.

2. Description of Related Arts

U.S. Patent No. 20150325944, issued on Nov. 12, 2015, discloses a waterproof electrical connector which comprises an insulation body, a metal shell, a plurality of terminals, a waterproof rubber, and a waterproof rubber ring. The waterproof rubber is located at a rear of the insulation body.

An improved waterproof electrical connector is desired.

SUMMARY OF THE INVENTION

Accordingly, an object of the present invention is to provide an electrical connector having a waterproof function.

To achieve the above object, an electrical connector includes an insulative housing having a groove, a tongue portion located in front of the groove, and a holding potion located behind the groove, the holding portion having a dispensing port communicating with the groove and an exterior; a plurality of contacts accommodated in the insulative housing, each contact having a contacting section exposed on the tongue portion, a connecting section exposed from the groove, a holding section accommodated in the holding portion of the insulative housing, and a soldering section extending from the holding portion; a metal shell attached to the housing and defining a receiving space in which the tongue portion is disposed; and a waterproof portion formed behind the receiving space and received in the groove.

Other objects, advantages and novel features of the invention will become more apparent from the following detailed description when taken in conjunction with the accompanying drawings.

DETAILED DESCRIPTION OF THE PREFERRED EMBODIMENT

Figure 1:
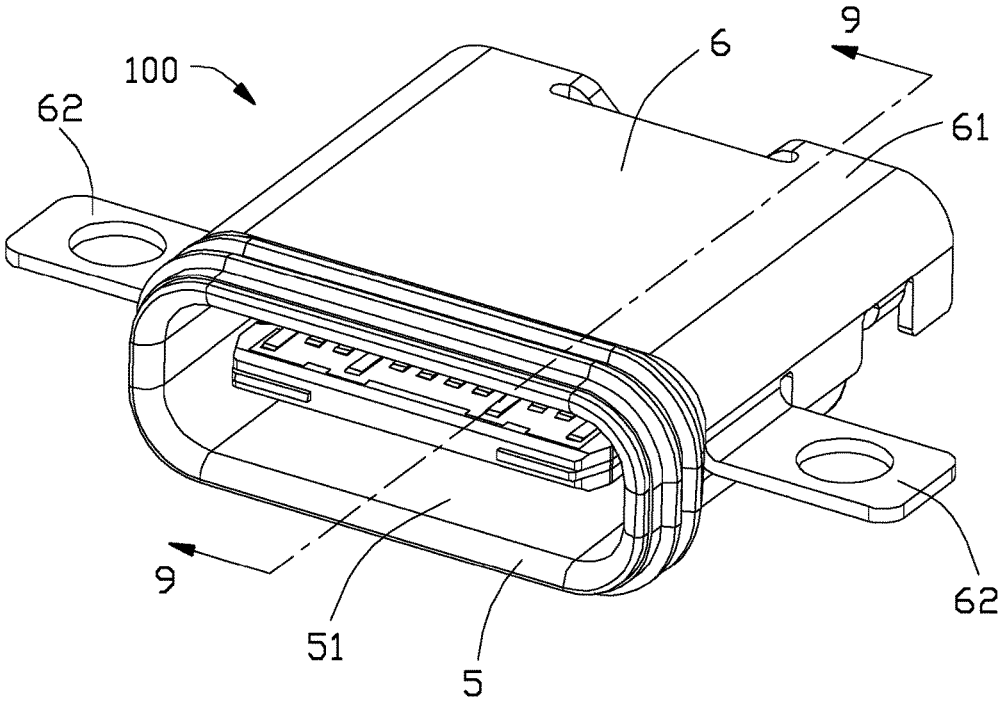
FIG. 1 is a perspective, assembled view of an electrical connector in accordance with the present invention.
Figure 2:
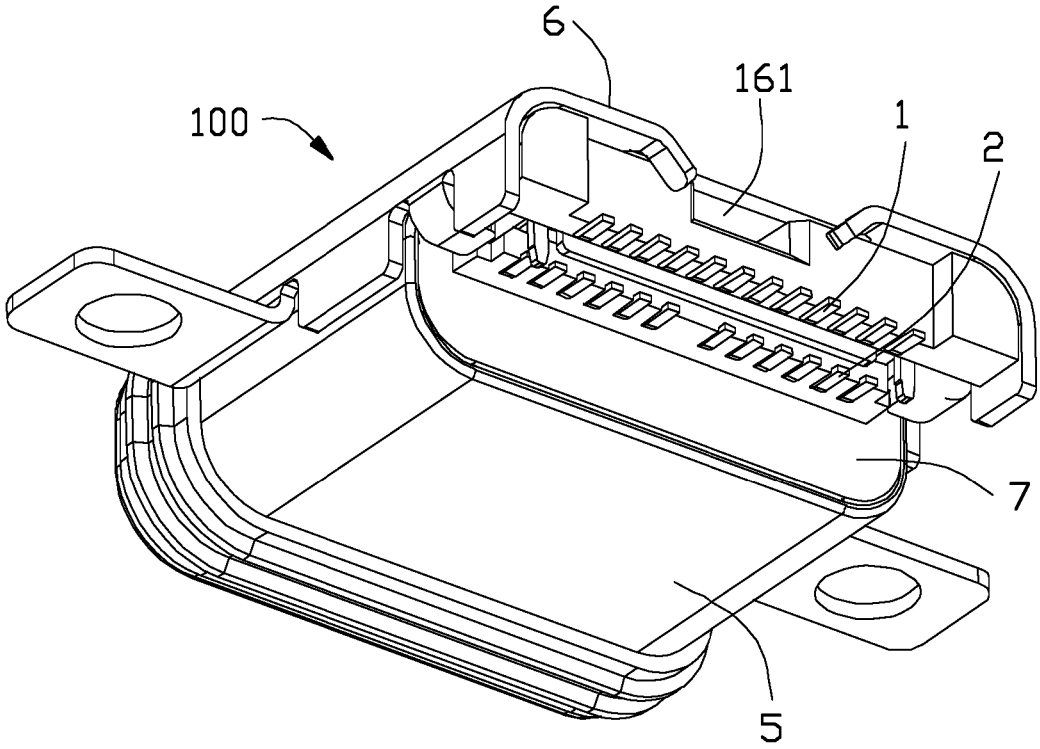
FIG. 2 is similar to FIG. 1, but taken from a different view.

Reference will now be made in detail to the preferred embodiment of the present invention.

Referring to FIGS. 1-11, an electrical connector 100 of the present invention comprises a first contact module 1, a second contact module 2, a grounding plate 3 sandwiched between the first contact module 1 and the second contact module 2, a base insulator 4 enclosing the first contact module 1 through over-molding process, the second module 2 and the grounding plate 3, a metal shell 5 attach to the base insulator 4, an extra shell 6 welded to the metal shell 5, and a waterproof portion 7 attached to a rear of the base insulator 4.

Figure 4:
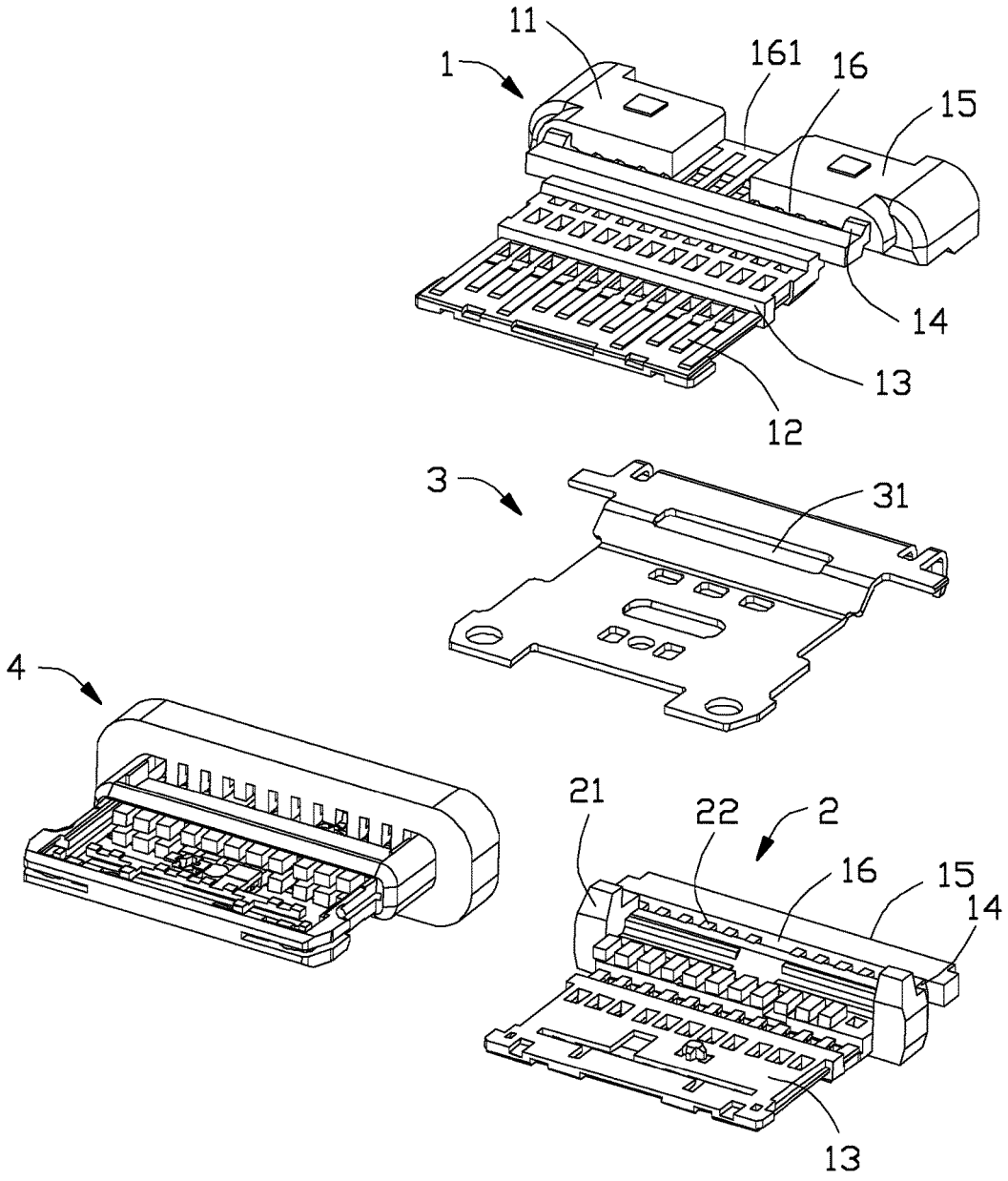
FIG. 4 is a perspective, exploded view of a first contact module, a second contact module, a grounding plate sandwiched between the first contact module and the second contact module and a base insulator assembled to the first contact module, the second contact module and the grounding plate.
Figure 5:
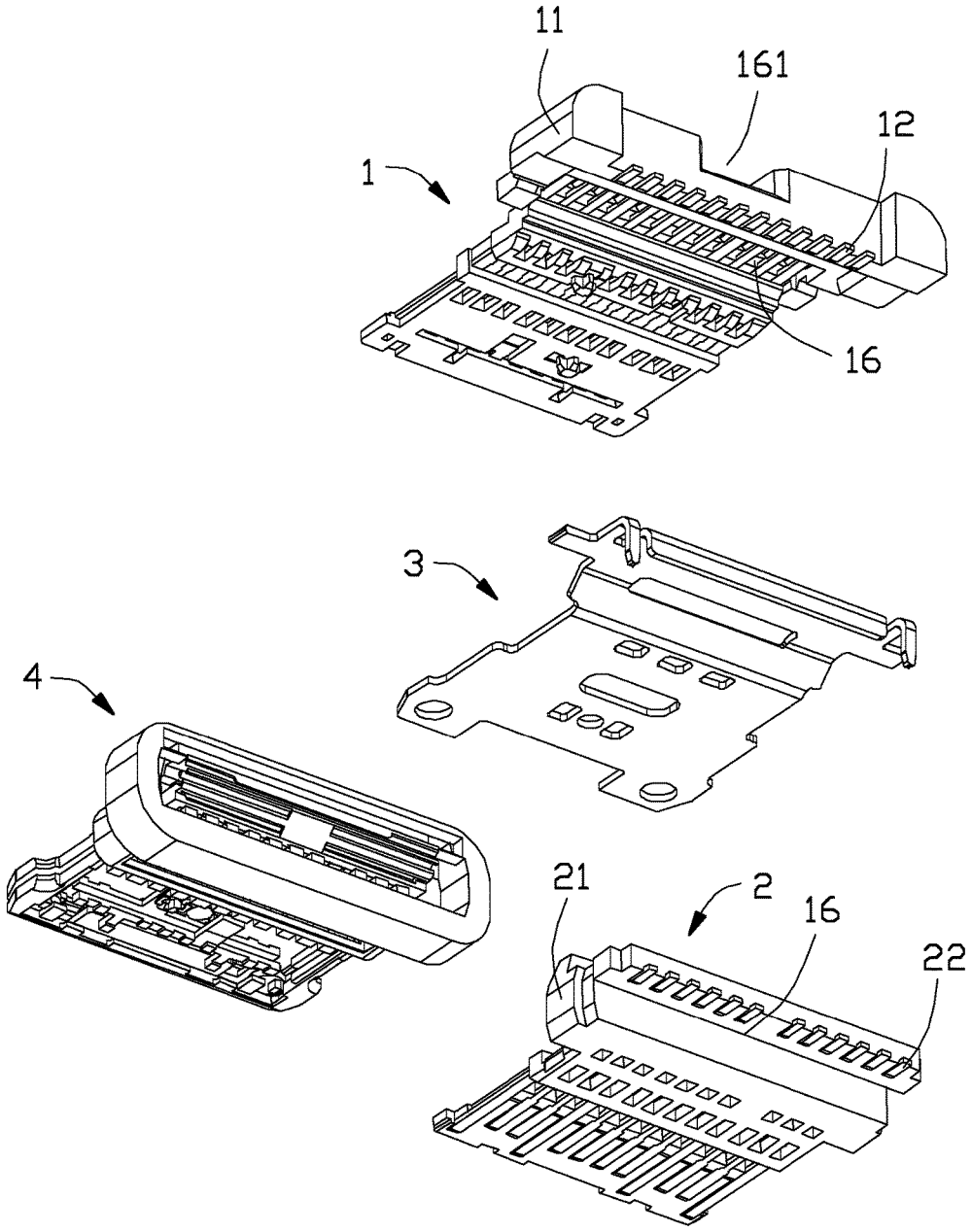
FIG. 5 is similar to FIG. 4, but taken from a different view.
Figure 6:
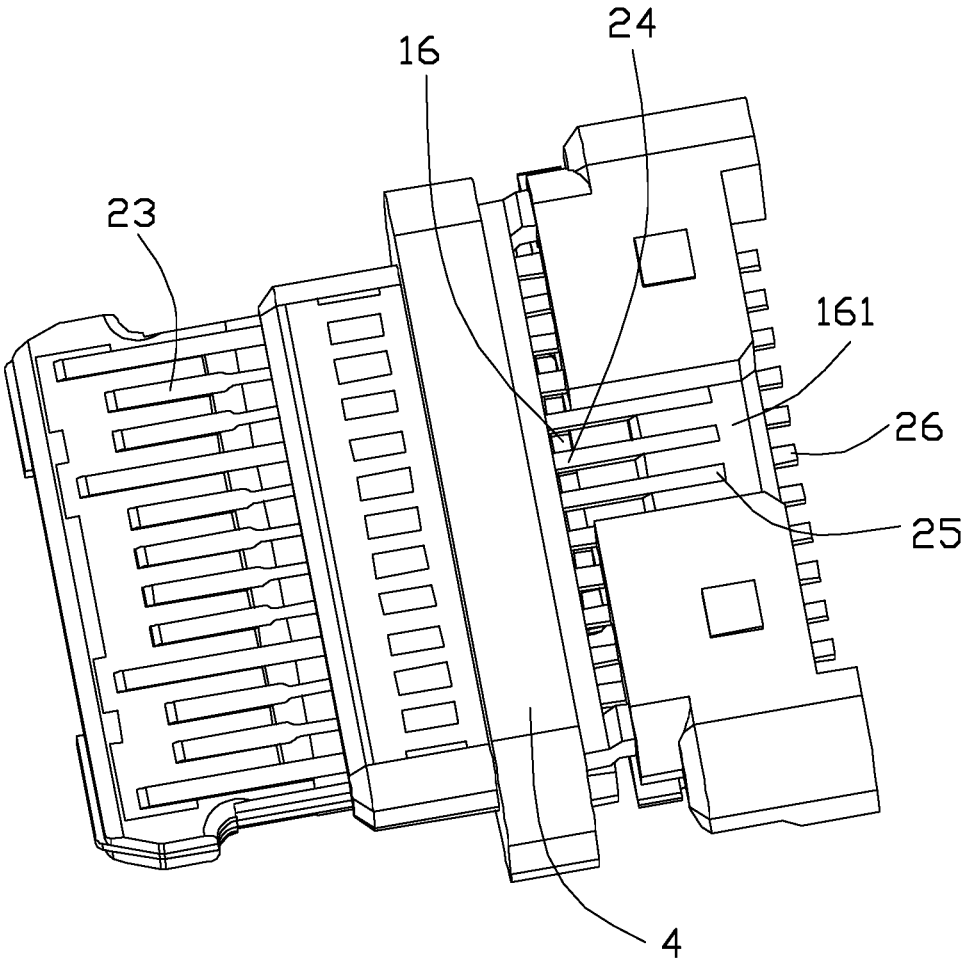
FIG. 6 is a perspective, assembled view of the first contact module, the second contact module, the grounding plate and the base insulator.

Referring to FIGS. 4 and 5, the first contact module 1 comprises an upper insulative housing 11 and a plurality of first contacts 12 accommodated in the upper insulative housing 11. The second contact module 2 comprises a lower insulative housing 21 and a plurality of second contacts 22 accommodated in the lower insulative housing 21. The upper insulative housing 11 and the lower insulative housing 21 comprise a tongue portion 13, a connecting portion 14 extending backwardly from two sides of the tongue portion 13, and a holding portion 15 connecting with a rear of the connecting portion 14, respectively. The upper insulative housing 11 and the lower insulative housing 21 define a groove 16 located among the tongue portion, the connecting portion 14 and the holding portion 15 for baring the first contacts 12 and the second contacts 22 respectively. The groove 16 of the upper insulative housing 11 and the lower insulative housing 21 are corresponding in up-and-down direction. The upper insulative housing 21 defines a dispensing port 161 communicating the groove 16 and an exterior out of the electrical connector 100.

Referring to FIGS. 4-5 and 8-9, the first contact 12 and the second contact 22 comprise contacting sections 23, connecting sections 24 extending backwardly from the contacting sections 23, holding sections 25, and soldering sections 26, respectively. The contacting sections 23 are exposed on the tongue portion 13, the connecting sections 24 are exposed in the groove 16, the holding sections 25 are accommodated in the holding portion 15, and the soldering sections 26 extend out of the holding portion 15. The first contact 12 and the second contact 22 extend along an insertion direction, the groove 16 extend along a transverse direction perpendicular to the insertion direction.

Referring to FIGS. 4 and 5, the grounding plate 3 is located between the first contact module 11 and the second contact module 21, and defines a notch 31 corresponding to the groove 16. The notch is located between the groove 16 of the upper insulative housing 11 and the lower insulative housing 21.

Figure 7:
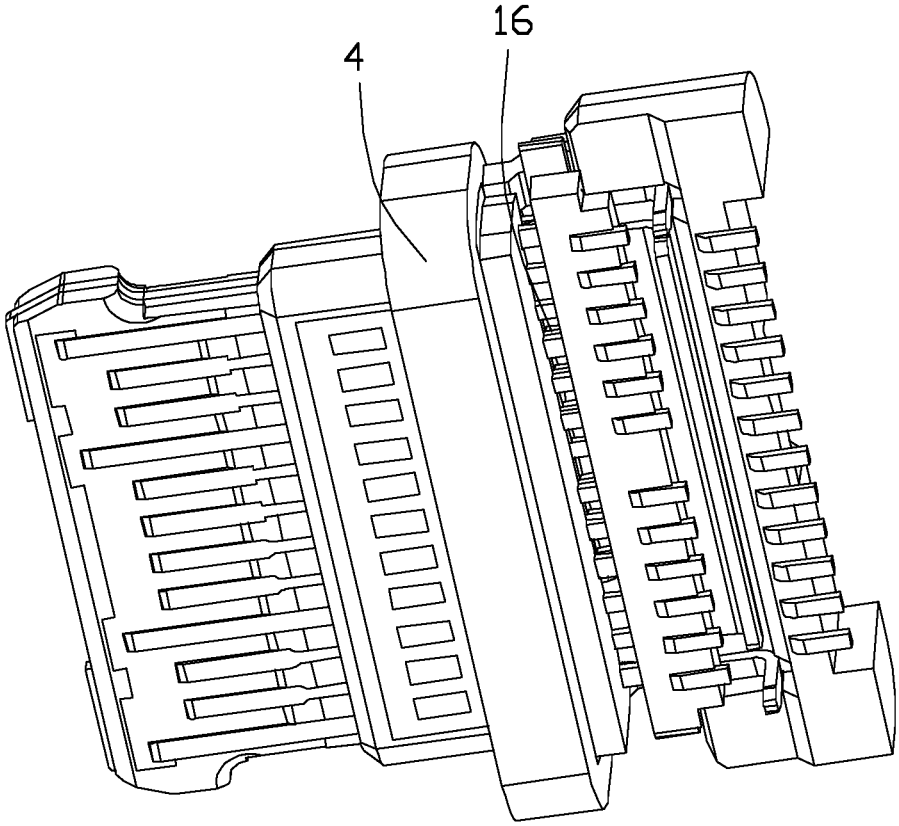
FIG. 7 is similar to FIG. 6, but taken from a different view.
Figure 8:
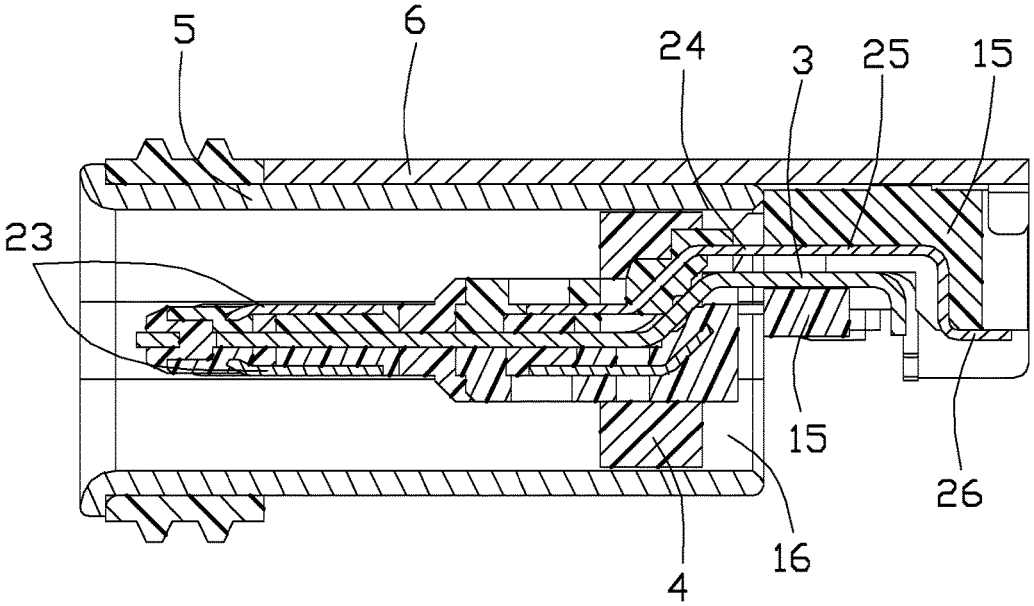
FIG. 8 is a cross-sectional view taken along line 8-8 of FIG. 3.
Figure 9:
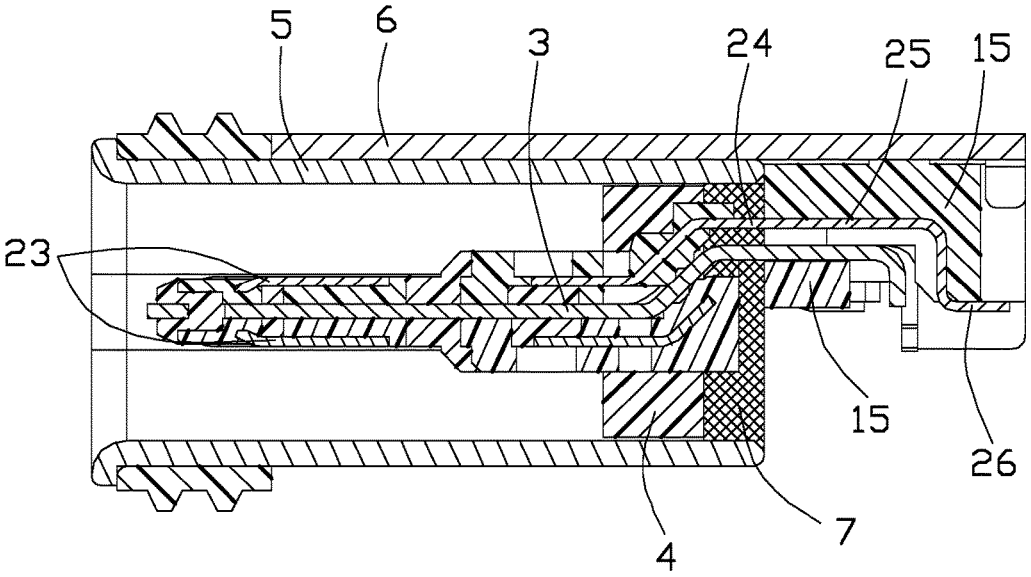
FIG. 9 is a cross-sectional view taken along line 9-9 of FIG. 1.
Figure 10:
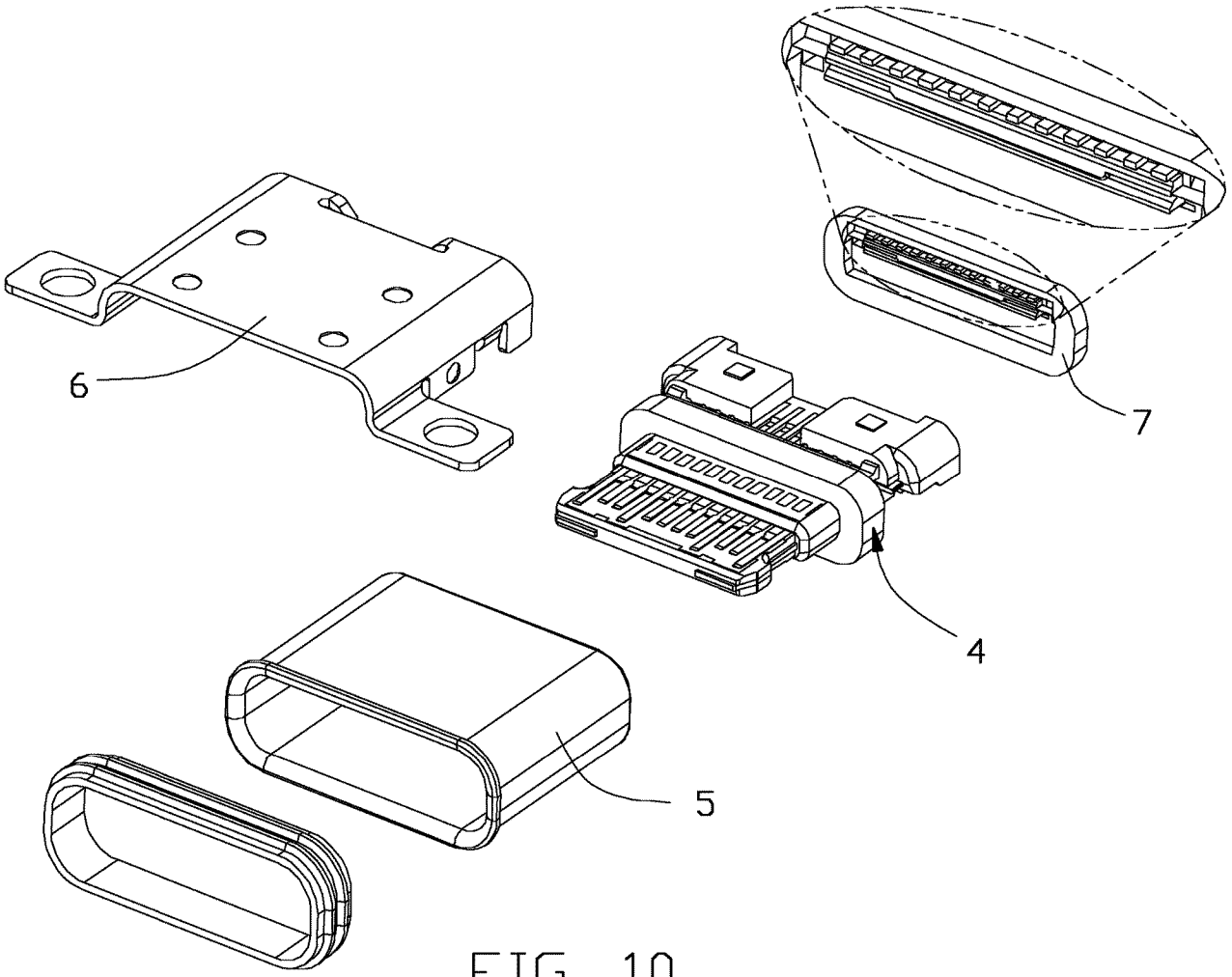
FIG. 10 is an exploded perspective view of the electrical connector of FIG. 1 to show the enlarged view of the waterproof portion thereof.
Figure 11:
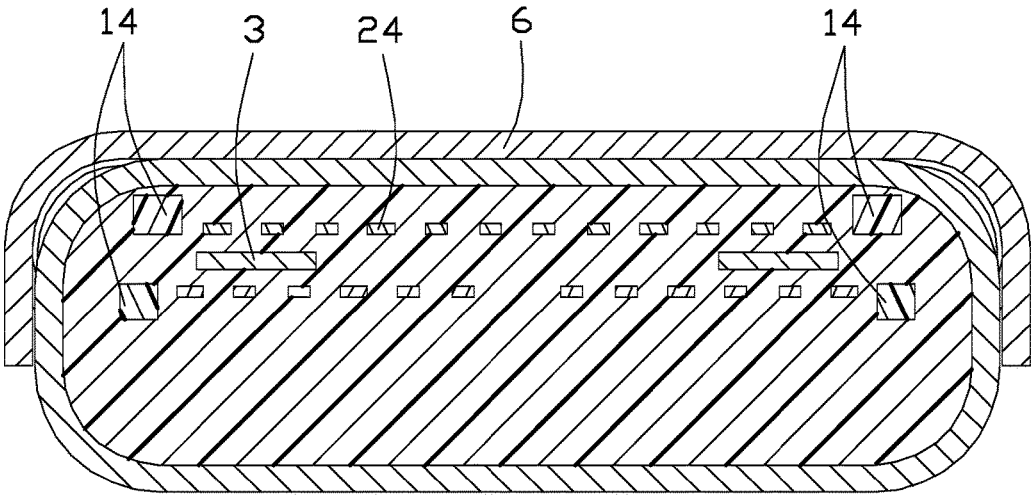
FIG. 11 is a cross-sectional view of the electrical connector of FIG. 1 to show how the connecting portions, the connecting sections and the grounding plate 3 extend therethrough in a front-to-back direction.

Referring to FIGS. 4 and 7, the base insulator 4 is formed out of the tongue portions 13 of the upper insulative housing 11 and the lower insulative housing 21 through over-molding process for fixing the first contact module 1, the second contact module 2 and the grounding plate 3. The groove 16 and the notch 31 are exposed out of a rear of the base insulator 4.

Referring to FIG. 1, the metal shell 5 is formed to be an integrated structure through pumping-molding process for a good waterproof function. The metal shell 5 is set around the first contact module 1, the second contact module 2, the grounding plate 3 and the base insulator 4, and defines a receiving space 51.

Figure 3:
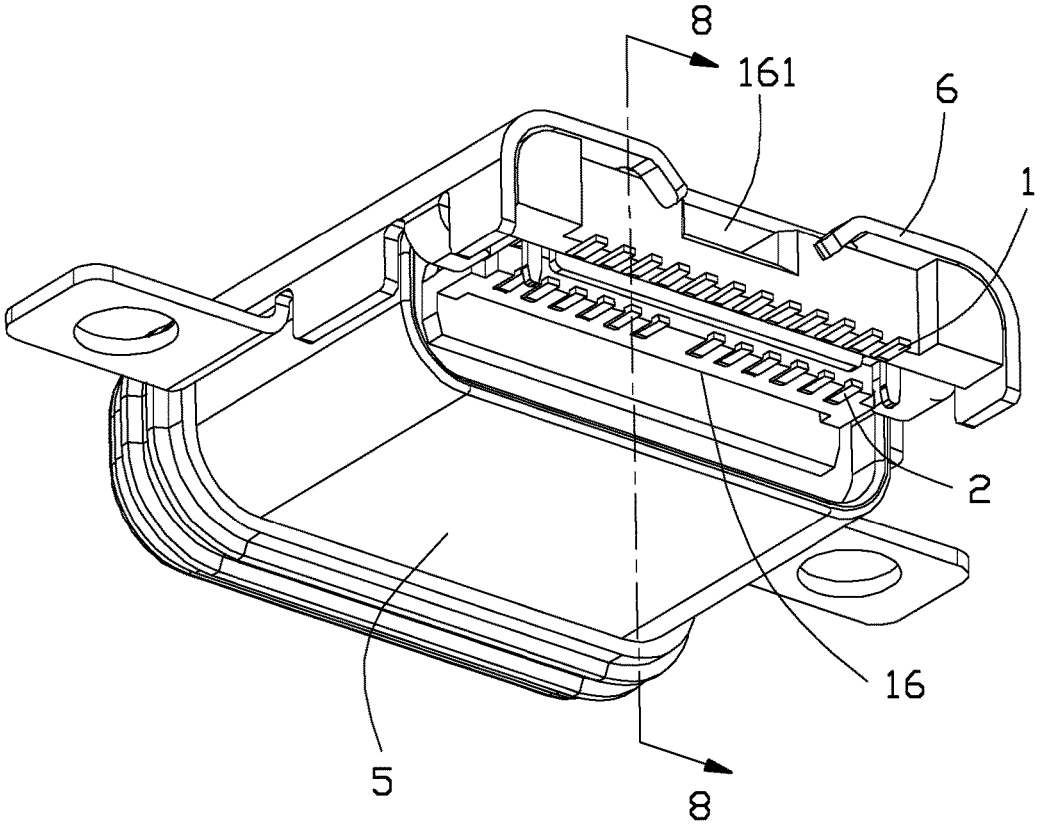
FIG. 3 is a perspective, partially assembled view of the electrical connector excluding a waterproof portion.

Referring to FIGS. 1 and 3, the extra shell 6 comprises a main portion 61 welding to the metal shell 5 and a pair of aural portions 62 located in two sides of the main portion 61. The aural portions 62 are used to be fixed to a printed circuit board (not shown).

Referring to FIGS. 1-3 and 8-9, the waterproof portion 7 is made from glue poured into the dispensing port 161 and flowing forwardly to the groove 16. The waterproof portion 7 is formed in the groove 16 and wraps the first contacts 12 and the second contacts 22. The waterproof portion 7 seals the notch 31 for wrapping the grounding plate 3 partially. The holding portion 15 exposed behind of the waterproof portion 7 can restrain the first contacts 12 and the second contacts 22 for ensuring the welding stability.

The preferred embodiment of the electrical connector 100 is used for insertion of a mating plug normally or reversely. Each contacting section 23 of the first contacts 12 is associated with a respective one of the second contacts 22 and is positioned in reverse symmetry with respect to the second contacts 22. In another embodiment, the electrical connector 100 comprises a whole insulative housing and a plurality of contacts accommodated in the insulative housing. The insulative housing comprises a groove 16, a tongue portion 13, a holding portion 15 located at a rear of the groove 16, and a connecting portion 14 located at two side of the groove 16. The groove 16 is located among the tongue portion 13, the connecting portion 14 and the holding portion 15. The holding portion 15 defines a dispensing port 161, the waterproof portion 7 is made from the glue flowing from the dispensing port 161 to the groove 16. The holding portion 15 exposed behind of the waterproof portion 7 can restrain the contacts for ensuring the welding stability.

A method of manufacturing the electrical connector 100 comprises the steps of:

Step 1: providing a plurality of contacts and insert-molding an insulative housing which retains the contacts. Wherein the insulative housing comprises a groove 16, a tongue portion 13 located in front of the groove 16, and a holding portion 15 located behind the groove 16, the holding portion 15 having a dispensing port 161 communicated with the groove 16 and the exterior. The contact having a contacting section 23 exposed on the tongue portion 13, a connecting section 24 exposed from the groove 16, a holding section 25 retained in the holding portion 15 of the insulative housing, and a soldering section 26 extending from the holding portion 15.

Step 2: assembling a metal shell 5 enclosing the insulative housing and the contacts; and Step 3: gluing from the dispensing port 161 and the glue flowing to the groove 16 to form a waterproof portion 7.

Step 1 above may further comprise: providing a first contact module 1 including an upper insulative housing 11 and a first contact 12 accommodated in the upper insulative housing 11, a second contact module 2 including a lower insulative housing 21 and a second contact 22 accommodated in the lower insulative housing 21, a grounding plate 3 sandwiched between the first contact module 1 and the second contact module 2, and over-molding a base insulator 4 out of the first contact module 1, the grounding plate 3 and the second contact module 2 to form an integrated structure.

In the present invention, the waterproof portion 7 is formed after assembling the metal shell 5 enclosing the insulative housing and the contacts. The glue can cohere the metal shell 5 close together for stuffing up a rear of the metal shell 5, and the waterproof function is good. The insulative housing extends to the rear of the waterproof portion 7 for restraining the contacts and ensuring the welding stability. It is noted that the rear edge of the groove 16 is terminated at a vertical plane defined by a peripheral rear edge of the shell 5. In other words, the holding portions 15 are located behind and exposed outside of the shell 5 while being hidden under a rear region of the extra shell 6. Another feature of the invention is to provide the waterproof portion with the corresponding through holes for allowing extension of the rear section of the grounding plate 3 and receiving connecting portions 14 and connecting sections 24. On the other hand, the grounding plate 3 forms the notch 31 to receive the waterproof portion 7 so as to assure securement between the grounding plate 3 and the waterproof portion 7.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising:

an insulative housing having a groove, a tongue portion located in front of the groove, and a holding portion located behind the groove, the holding portion having a dispensing port communicating with the groove and an exterior;

a plurality of contacts accommodated in the insulative housing, each contact having a contacting section exposed on the tongue portion, a connecting section exposed in the groove, a holding section and a soldering section extending from the holding portion;

a metal shell attached to the housing up to a front face of the holding portion and defining a receiving space in which the tongue portion is disposed; and a waterproof portion formed in the groove and sealing a gap between the shell and the housing around said groove.

2. The electrical connector as claimed in claim 1, wherein said contacts extend in an insertion direction, and the groove extends in a transverse direction perpendicular to the insertion direction.

3. The electrical connector as claimed in claim 2, wherein said waterproof portion is rearwardly exposed to the exterior.

4. The electrical connector as claimed in claim 1, wherein said insulative housing comprises a connecting portion located by two sides of the groove, and the groove is located between the tongue portion, the connecting portion, and the holding portion.

5. The electrical connector as claimed in claim 1, wherein the insulative housing comprises an upper insulative housing and a lower insulative housing located in an up-and-down direction, the groove is located at the upper insulative housing and the lower insulative housing, the contacts comprise a plurality of first contacts accommodated in the upper insulative housing and a plurality of second contacts accommodated in the lower insulative housing, and each contacting section of the first contacts is positioned in reverse symmetry with respect to a respective one of the second contacts.

6. The electrical connector as claimed in claim 5, further comprising a grounding plate sandwiched between the upper insulative housing and the lower insulative housing.

7. The electrical connector as claimed in claim 6, wherein the grounding plate defines a notch corresponding to the groove, and the waterproof portion sealing the notch.

8. The electrical connector as claimed in claim 6, wherein the waterproof portion wraps the connecting sections, a connecting portion of the housing located by two sides of the groove, and portions of the grounding plate located by two sides of the notch.

9. The electrical connector as claimed in claim 1, wherein said metal shell is formed to be an integrated structure through a drawing process.

10. The electrical connector as claimed in claim 1, wherein the waterproof portion is formed after assembling the metal shell to enclose the insulative housing and the contacts.

11. The electrical connector as claimed in claim 1, wherein the housing further includes a connecting portion unitarily linked between the tongue portion and the holding portion, and said connecting portion extends through the waterproof portion in a front-to-back direction.

12. A method for manufacturing an electrical connector, comprising steps of:

providing a plurality of contacts and insert-molding an insulative housing with the contacts, wherein the insulative housing comprises a groove, a tongue portion located in front of the groove, and a holding portion located behind the groove, each contact having a contacting section exposed on the tongue portion, a connecting section exposed in the groove, a holding section retained in the holding portion of the insulative housing, and a soldering section extending from the holding portion;

assembling a metal shell to enclose the insulative housing and the contacts; and applying glue into the groove to form a waterproof portion to seal a gap between the housing and the shell around said groove; wherein the holding portion forms a dispensing port communicating with the groove and an exterior in a front-to-back direction so as to allow said glue to be injected into the groove through the dispensing port from the exterior.

13. The method as claimed in claim 12, further including a step of providing a first contact module and a second contact module respectively having an insulative housing and a plurality of contacts, and a grounding plate sandwiched between the first contact module and the second contact module located in an up-and-down direction, and insert-molding a base insulator into the first contact module, the second contact module, and the grounding plate to form an integrated structure.

14. The method as claimed in claim 12, wherein the housing further includes a connecting portion unitarily linked between the tongue portion and the holding portion and located within the groove.

15. An electrical connector comprising:

an insulative housing having a groove, a tongue portion located in front of the groove in a front-to-back direction, and a holding potion located behind the groove;

a plurality of contacts accommodated in the insulative housing, each contact having a contacting section exposed on the tongue portion, a connecting section exposed in the groove, a holding section accommodated in the holding portion of the insulative housing, and a soldering section extending out of the holding portion;

a metal shell attached to the housing in a circumferential manner and defining a receiving space in which the tongue portion is disposed; and a waterproof portion formed in the groove to seal a gap between the shell and the housing around said groove; wherein the housing further includes a connecting portion unitarily formed between the tongue portion and the holding portion, located within the groove, and extending through the waterproof portion in the front-to-back direction.

16. The electrical connector as claimed in claim 15, wherein said waterproof portion is rearwardly exposed to an exterior.

17. The electrical connector as claimed in claim 15, further including a grounding plate embedded within the tongue portion, wherein said waterproof portion forms through holes to allow the connecting sections of the contacts, the connection portion of the housing, and corresponding portions of said grounding plate to rearwardly extend therethrough.

18. The electrical connector as claimed in claim 17, wherein said grounding plate forms a notch in which said waterproof portion is filled.

19. The electrical connector as claimed in claim 15, wherein said shell forms a rear edge where the waterproof portion is terminated rearwardly.

20. The electrical connector as claimed in claim 15, wherein said housing includes a base insulator to enclose the tongue portion, and said base insulator and said tongue portion respectively rearwardly and communicatively face the groove at different positions along said front-to-back direction, and said base insulator is terminated in the groove at a position in front of said that where the tongue portion is terminated in the groove.

* * * * *